US010157700B2

(12) United States Patent
Arai et al.

(10) Patent No.: US 10,157,700 B2
(45) Date of Patent: Dec. 18, 2018

(54) METHOD FOR PRODUCING RESISTOR

(71) Applicant: KOA CORPORATION, Ina-shi, Nagano (JP)

(72) Inventors: Kosuke Arai, Nagano (JP); Tadahiko Yoshioka, Nagano (JP)

(73) Assignee: KOA CORPORATION, Nagano (JP)

( * ) Notice: Subject to any disclaimer, the term of this patent is extended or adjusted under 35 U.S.C. 154(b) by 276 days.

(21) Appl. No.: 15/304,989

(22) PCT Filed: Apr. 9, 2015

(86) PCT No.: PCT/JP2015/061067
§ 371 (c)(1),
(2) Date: Oct. 18, 2016

(87) PCT Pub. No.: WO2015/163153
PCT Pub. Date: Oct. 29, 2015

(65) Prior Publication Data

US 2017/0221614 A1 Aug. 3, 2017

(30) Foreign Application Priority Data

Apr. 25, 2014 (JP) ..... 2014-091906

(51) Int. Cl.

| | |
|---|---|
| ***H01C 17/28*** | (2006.01) |
| ***H01C 1/01*** | (2006.01) |
| ***H01C 1/14*** | (2006.01) |
| ***H01C 1/16*** | (2006.01) |
| ***H01C 17/00*** | (2006.01) |

(Continued)

(52) U.S. Cl.
CPC ..... *H01C 17/28* (2013.01); *H01C 1/01* (2013.01); *H01C 1/14* (2013.01); *H01C 1/16* (2013.01); *H01C 17/006* (2013.01); *H01C 17/24* (2013.01); *H01C 17/245* (2013.01); *Y10T 29/49082* (2015.01); *Y10T 29/49101* (2015.01)

(58) Field of Classification Search
CPC . H01C 1/01; H01C 1/014; H01C 1/14; H01C 1/144; H01C 1/148; H01C 17/00; H01C 17/006; H01C 17/22; H01C 17/23; H01C 17/24; H01C 17/242; H01C 17/245; H01C 17/28; Y10T 29/49082; Y10T 29/49098; Y10T 29/49101
See application file for complete search history.

(56) References Cited

U.S. PATENT DOCUMENTS 4,792,781 A * 12/1988 Takahashi ..... H01C 17/006 29/610.1
7,330,099 B2 * 2/2008 Tsukada ..... H01C 1/144 338/307

(Continued)

*Primary Examiner* — Peter DungBa Vo
*Assistant Examiner* — Joshua D Anderson
(74) *Attorney, Agent, or Firm* — Brinks Gilson & Lione

(57) ABSTRACT

Provided is a method for producing a resistor, including a step of forming a through-hole in a sheet-like conductive material; a step of fitting a resistive element piece into the through-hole and thus forming joint portions where end surfaces of the resistive element piece are joined to respective side surfaces of the conductive material exposed by the through-hole; and stamping a region including the joint portions from the conductive material, thereby forming a resistor including a resistive element and a pair of electrodes.

11 Claims, 8 Drawing Sheets

(51) Int. Cl.
*H01C 17/24* (2006.01)
*H01C 17/245* (2006.01)

(56) References Cited

U.S. PATENT DOCUMENTS

| | | | | |
|---|---|---|---|---|
| 8,193,899 | B2 * | 6/2012 | Takeuchi | H01C 1/06 338/262 |
| 2007/0159295 | A1 * | 7/2007 | Wang | H01C 17/006 338/307 |
| 2009/0002121 | A1 * | 1/2009 | Tsai | H01C 1/142 338/195 |
| 2013/0187749 | A1 * | 7/2013 | Tsukada | H01C 1/148 338/306 |
| 2014/0152419 | A1 * | 6/2014 | Naka | H01C 1/01 338/314 |

* cited by examiner

METHOD FOR PRODUCING RESISTOR

This application is a 371 application of PCT/JP2015/061067 having an international filing date of Apr. 9, 2015, claiming priority to JP2014-091906 filed Apr. 25, 2014, the entire contents of which are incorporated herein by reference.

TECHNICAL FIELD

The present invention relates to a method for producing a resistor.

BACKGROUND ART

A method disclosed in Patent Literature 1 below is known as a method for producing a resistor. According to Patent Literature 1, a number of chip resistors can be easily obtained by being stamped from a sheet material.

CITATION LIST

Patent Literature

Patent Literature 1: JP 2011-114038 A

SUMMARY OF INVENTION

Technical Problem

The method disclosed in Patent Literature 1 uses a sheet material for resistive elements. Thus, there is a problem in that the amount of waste of the sheet material after the resistive elements are stamped therefrom is large.

It is an object of the present invention to provide a method for producing a resistor with a butt joint structure in which end surfaces of a resistive element and electrodes are butt-joined together.

Solution to Problem

According to an aspect of the preset invention, there is provided a method for producing a resistor, including a step of forming a through-hole in a sheet-like conductive material; a step of fitting a resistive element piece into the through-hole and thus forming joint portions where end surfaces of the resistive element piece are (butt-)joined to respective side surfaces of the conductive material exposed by the through-hole; and stamping a region including the joint portions from the conductive material, thereby forming a resistor including a resistive element and a pair of electrodes.

In the step of producing a resistor with a butt joint structure in which end surfaces of a resistive element and electrodes are but-joined together, a resistive element piece is fitted into a through-hole in a sheet-like conductive material, whereby the amount of waste of the material of the resistive element can be reduced.

The step of forming the joint portions preferably includes a step of welding two side surfaces of the resistive element piece to the respective side surfaces in the through-hole at the joint portions.

The step of fitting the resistive element piece includes a step of press-fitting the resistive element piece into the through-hole.

Accordingly, a butt joint structure can be easily formed.

In the step of stamping the region including the joint portions, the width of the region to be stamped is preferably set narrower than the width of each joint portion.

When the joint portions are welded, a welding start position and a welding end position are excluded from the region to be stamped, whereby a resistor without a shape-deteriorated portion at the welding start position and the welding end position can be produced.

The step of forming the through-hole includes providing a protrusion at a bottom of the through-hole, the protrusion protruding from an inner surface of the sheet-like conductive material on the through-hole side toward the through-hole.

The present specification incorporates the content described in the specification and/or the drawings of JP Patent Application No. 2014-091906 that claims the priority of the present application.

Advantageous Effects of Invention

According to the method for producing a resistor of the present invention, there is an advantage in that resistors with butt joint structures can be efficiently mass-produced.

BRIEF DESCRIPTION OF DRAWINGS

FIGS. 6A and 6B show steps corresponding to FIGS. 1B and 2B, respectively; and FIG. 6C is a bottom perspective view showing the resistor in FIG. 6B.

DETAILED DESCRIPTION OF THE PREFERRED EMBODIMENTS

Hereinafter, a method for producing a resistor with a butt joint structure in which end surfaces of a resistive element and electrodes are butt-joined together in accordance with an embodiment of the present invention will be described in detail with reference to the drawings.

First Embodiment

FIGS. 1A to 1D are plan views each showing an exemplary step of a method of producing a resistor with a butt joint structure in accordance with the first embodiment of the present invention. FIGS. 2A to 2D are cross-sectional views or perspective views corresponding to FIGS. 1A to 1D, respectively. FIG. 3 is a view showing a step of producing a resistive element piece that is used for producing a butt joint structure.

Figure 1A:
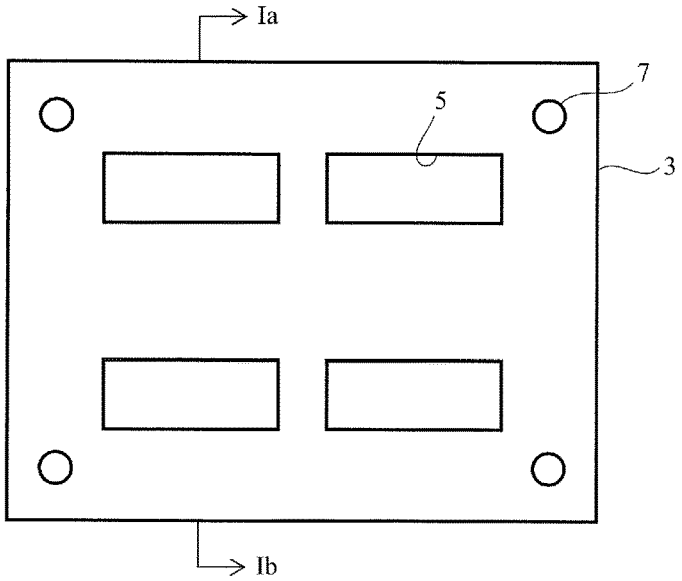
FIG. 1A is a plan view showing an exemplary step of producing a resistor with a butt joint structure in accordance with the first embodiment of the present invention.
Figure 1B:
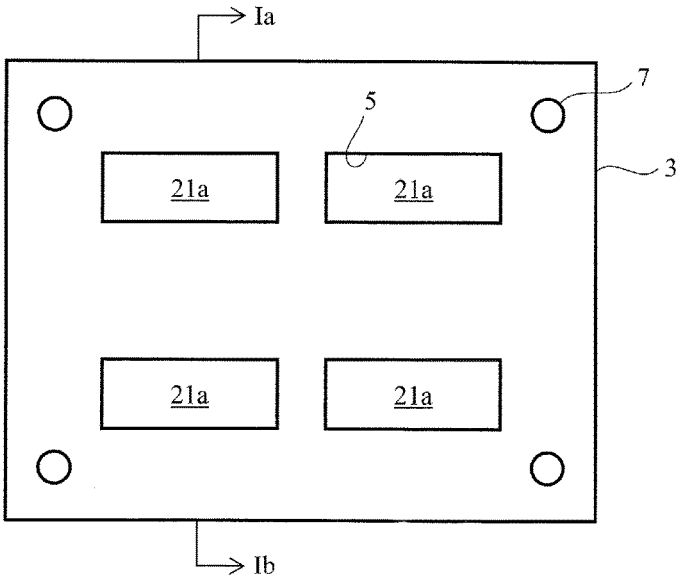
FIG. 1B is a plan view showing an exemplary step of producing a resistor with a butt joint structure in accordance with the first embodiment of the present invention.
Figure 1C:
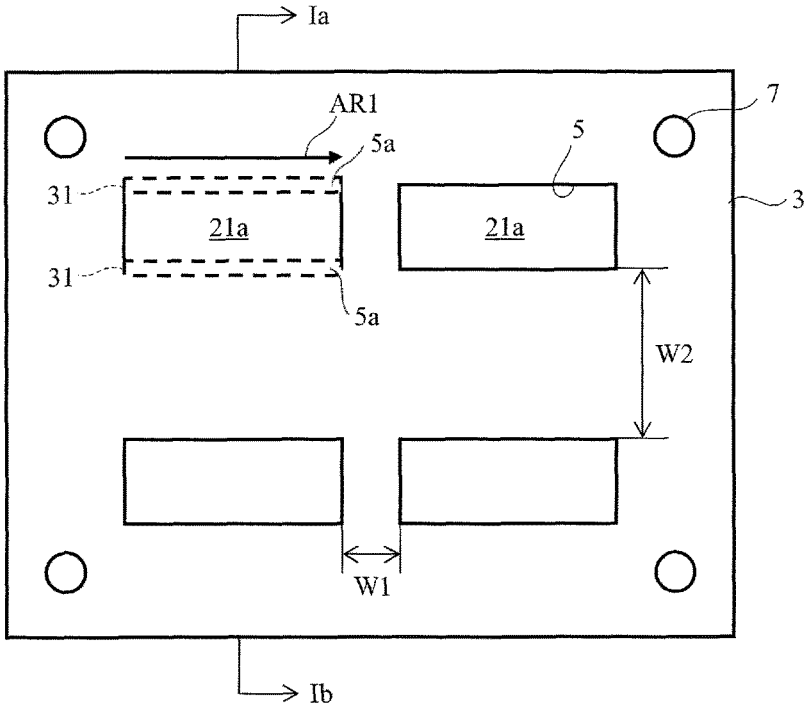
FIG. 1C is a plan view showing an exemplary step of producing a resistor with a butt joint structure in accordance with the first embodiment of the present invention.
Figure 1D:
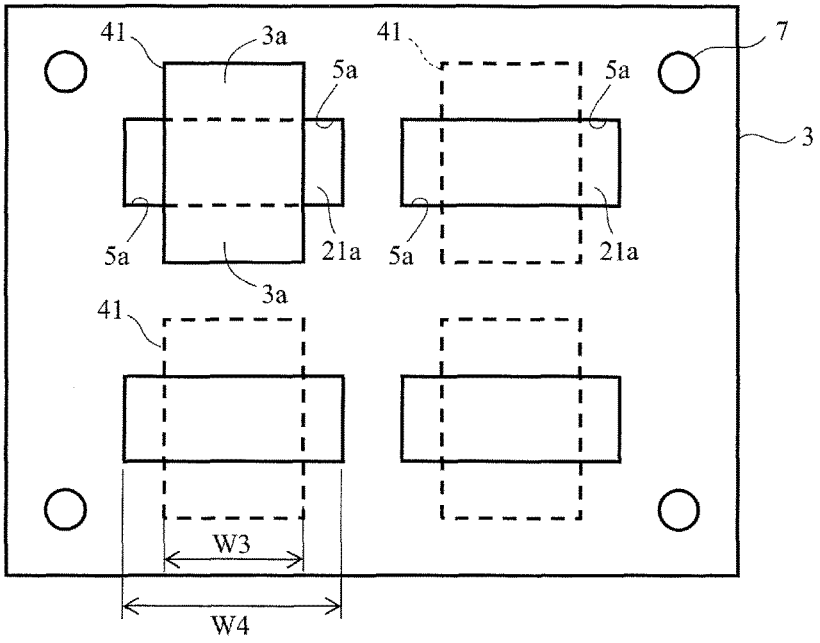
FIG. 1D is a plan view showing an exemplary step of producing a resistor with a butt joint structure in accordance with the first embodiment of the present invention.
Figure 2A:
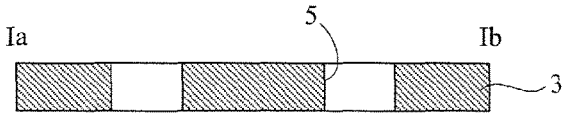
FIG. 2A is a cross-sectional view corresponding to FIG. 1A.

As shown in FIGS. 1A to 2A, first, an electrode plate 3 made of a sheet-like conductive material, which will become electrodes of resistors, for example, a metal material such as Cu is prepared. Then, through-holes 5, which are dimensioned to allow resistive elements to be fitted therein, are formed in the electrode plate 3 in the thickness direction thereof using a punch or the like. It should be noted that holes 7 are positioning holes. FIG. 2A is a cross-sectional view along line Ia-Ib in FIG. 1A.

Meanwhile, as shown in FIG. 3, a small piece of a resistive element made of a Cu—Ni-based material, a Cu—Mn-based material, a Ni—Cr-based material, or the like is formed in advance. In the example shown in FIG. 3, a resistive element piece 21*a* with a length that is about equal to the length of the short side of each through-hole 5 is cut out of a long resistive element plate 21 with a width that is about equal to the length of the long side of each through-hole 5, using a cutter, for example. The thickness of the resistive element plate 21 may be about equal to the thickness of the electrode plate 3, for example. It should be noted that the resistive element piece 21*a* has a size that allows, when the resistive element piece 21*a* is fitted into the through-hole 5, outer side surfaces of the resistive element piece 21*a* (at least two opposite surfaces in a region cut out with a punch or the like in FIG. 1D described below) to be in tightly in contact with the through-hole 5 along the inner wall thereof.

Figure 2B:
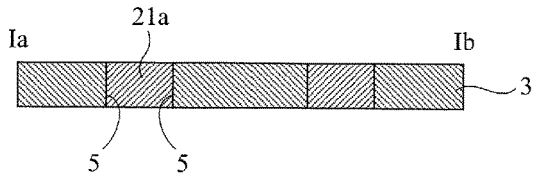
FIG. 2B is a cross-sectional view corresponding to FIG. 1B.
Figure 3:
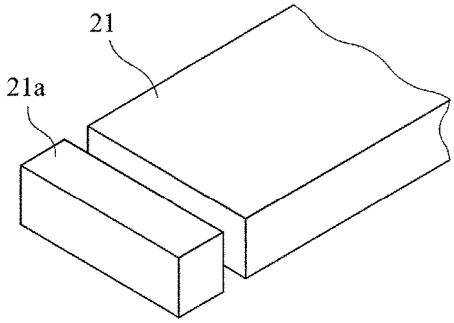
FIG. 3 is a view showing a step of producing a resistive element piece that is used for producing a butt joint structure.

Next, as shown in FIGS. 1B and 2B, the resistive element piece 21*a* is fitted into the through-hole 5 in the electrode plate 3. Accordingly, joint portions are formed where the two opposite outer side surfaces of the resistive element piece 21*a* (end surfaces of the resistive element piece 21*a*) are connected to the respective inner surfaces of the electrode plate 3 exposed by the through-hole 5.

The size of the plane of the resistive element piece 21*a* corresponding to the opening of the through-hole 5 is preferably set slightly larger than the through-hole 5 so that the resistive element piece 21*a* can be press-fitted into the through-hole 5. Accordingly, it is possible to avoid the generation of a gap and thus obtain a favorable connection between the resistive element and electrodes when the resistive element piece 21*a* is fitted into the through-hole 5.

Figure 2C:
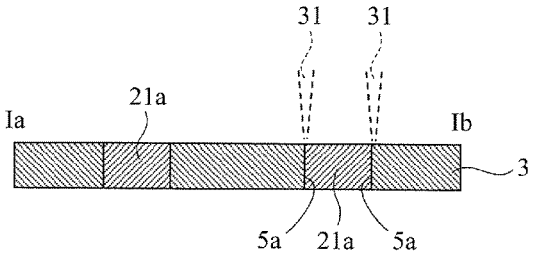
FIG. 2C is a cross-sectional view corresponding to FIG. 1C.

Next, as shown in FIGS. 1C and 2C, the resistive element piece 21*a* and the electrode plate 3 are welded together at joint portions 5*a* that are oriented along the long side of the through-hole 5. That is, a resistive element and electrodes are welded together using a laser beam or the like along the two joint portions 5*a* where the two side surfaces (outer peripheral surfaces) of the resistive element piece 21*a* are joined to the respective inner surfaces of the electrode plate 3 exposed by the through-hole 5. An example of the direction in which welding is performed is indicated by an arrow AR1. As a welding method, electron beam welding and the like can also be used in addition to the laser beam welding.

Thus, the joint portions 5*a* can be formed where the two side portions of the resistive element piece 21*a* are butt-joined to the respective side wall portions in the through-hole 5.

It should be noted that as shown in FIG. 1C, a second through-hole is formed in the electrode plate 3 with a predetermined gap secured with respect to the first through-hole 5, that is, W1 in the length direction and W2 in the width direction secured with respect to the first through-hole 5 so that another resistive element piece 21*a* can be fitted into the second through-hole. Accordingly, it is possible to avoid the welded portions from becoming too long and also avoid the warping of the electrode plate 3 by laser welding.

Next, as shown in FIG. 1D, a to-be-stamped region 41 including the two opposite joint portions 5*a* and also including portions 3*a*, 3*a* of the electrode plate 3 oriented in two directions, which are perpendicular to the extended direction of the joint portions 5*a*, is stamped using a punch or the like. Stamping such a region including the joint portions 5*a* from the electrode plate 3 can produce a resistor 1 in which the end surfaces of the resistive element 21*a* and the respective pair of electrodes 3*a*, 3*a* are butt-joined together.

If the stamp width (W3) is set narrower than the width of each joint portion 5*a* (W4), it is possible to produce a resistor without deteriorated portions by excluding from the to-be-stamped region shape-deteriorated portions at the welding start position and the welding end position that are formed at opposite ends of each joint portion 5*a*.

Figure 2D:
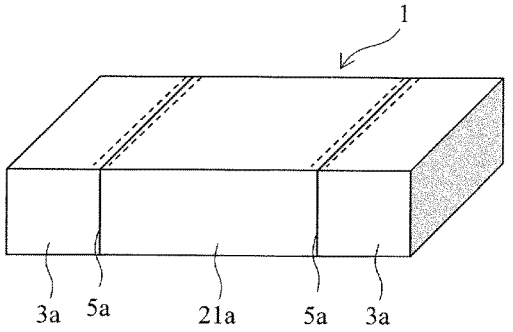
FIG. 2D is a perspective view of a resistor after stamping in FIG. 1D.

The stamped portion is the resistor 1 with a butt joint structure in which the electrodes 3*a*, 3*a* are formed at opposite ends of the resistive element piece 21*a* as shown in FIG. 2D. Welding spots are seen at the joint portions 5*a*.

Accordingly, the resistor 1 with a butt joint structure can be produced.

According to the present embodiment, resistive element pieces are fitted into through-holes formed in a metal plate for electrodes. Therefore, there is an advantage in that the amount of waste of the resistive element pieces can be reduced.

Second Embodiment

Figure 4A:
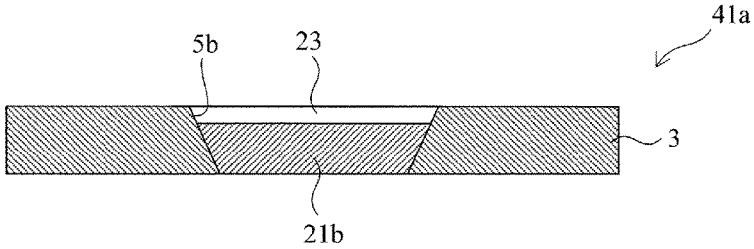
FIGS. 4A and 4B are views each showing a step of a method for producing a resistor in accordance with the second embodiment of the present invention, and showing an exemplary positioning technique for fitting a resistive element piece into a through-hole in an electrode plate.

Next, the second embodiment of the present invention will be described. FIG. 4 are views each showing an exemplary positioning structure for fitting a resistive element piece into a through-hole in the electrode plate 3. As shown in FIG. 4A, a through-hole 5*b* is formed such that it has a tapered cross-section where the dimensions of the hole gradually become smaller in the thickness direction, while a resistive element piece 21*b* is also formed such that its cross-sectional dimensions gradually become smaller in accordance with the through-hole 5*b*. If the tapered angle is set such that the lower surface of the resistive element piece 21*b* and the bottom portion of the through-hole 5*b* are located at the same position when the resistive element piece 21*b* is fitted into the through-hole 5*b*, there is an advantage in that positioning in the thickness direction of the resistive element piece 21*b* and the depth direction of the through-hole 5*b* can be automatically performed. It should be noted that if the thickness of the resistive element piece 21*b* is adjusted such that a space as indicated by reference numeral 23 is formed above the through-hole 5*b*, it is possible to form a desired step between the upper surface of the electrode plate 3 and the upper surface of the resistive element piece 21*b*. Thus, it becomes easier to mount the resulting resistor on a wiring pattern and the like.

Figure 4B:
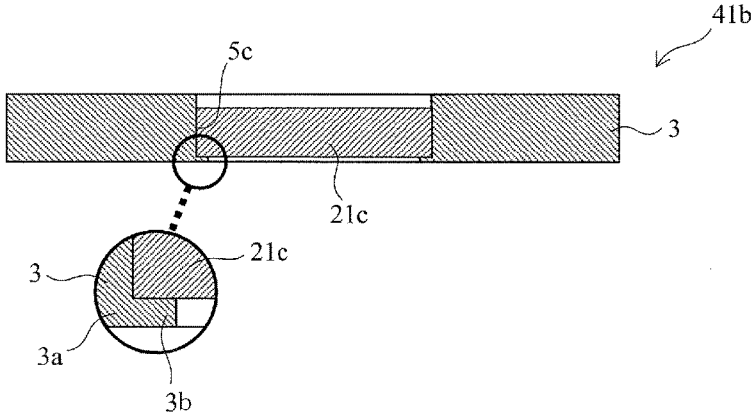

In addition, as shown in FIG. 4B, it is also possible to form a narrow portion of the through-hole 5*c* at the bottom thereof. That is, it is possible to, by providing a small protrusion 3*b* or the like, which protrudes from the inner surface of the electrode plate 3 on the through-hole side toward the through-hole 5*c*, in the through-hole 5*c*, for example, and thus allowing the bottom surface of a resistive element piece 21*c* to abut the upper surface of the protrusion (projection) 3*b* while the resistive element piece 21*c* is fitted into the through-hole 5*c*, perform positioning in the thickness direction of the resistive element piece 21*c*.

Figure 5A:
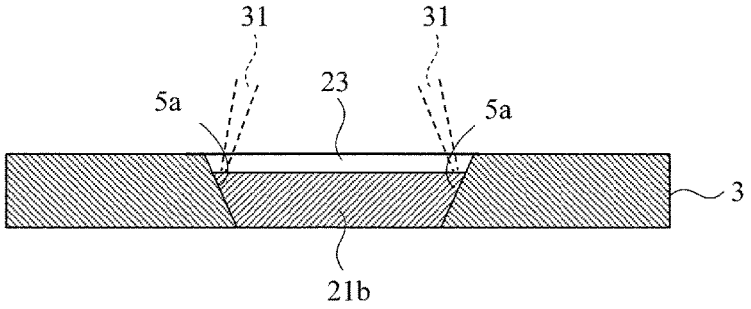
FIGS. 5A and 5B are views showing exemplary steps of welding joint portions after resistive element pieces are fitted into the structures in FIGS. 4A and 4(*b*), respectively.
Figure 5B:
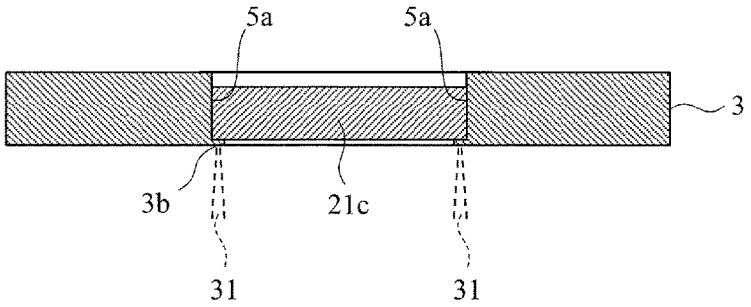

FIGS. 5A and 5B are views showing exemplary steps of welding the joint portions 5*a* after the resistive element pieces 21*b* and 21*c* are fitted into the structures in FIGS. 4A and 4B, respectively. In the example shown in FIG. 5A, in the state of FIG. 4A, the inside of the recess (space) 23 of the through-hole is irradiated with laser beams 31, using laser welding as a welding method, for example. Therefore, there is an advantage in that welding spots are not formed on the outer surface, which would otherwise obstruct mounting.

Meanwhile, with respect to the structure in FIG. 4B, it is also possible to weld the joint portions 5*a* by irradiating the protrusion 3*b* with laser beams 31 as shown in FIG. 5B. Such a structure is advantageous in that the protruding portion prevents the warping of the electrode plate 3 by laser and the like during welding.

Third Embodiment

Figure 6A:
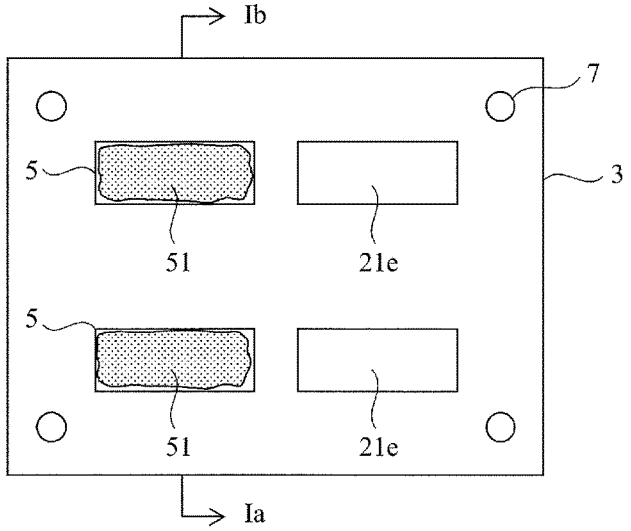
FIGS. 6A, 6B and 6C each show a step of a method for producing a resistor in accordance with the third embodiment of the present invention; specifically.
Figure 6B:
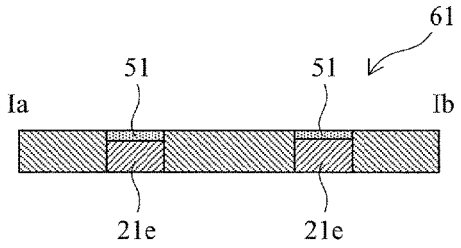
Figure 6C:
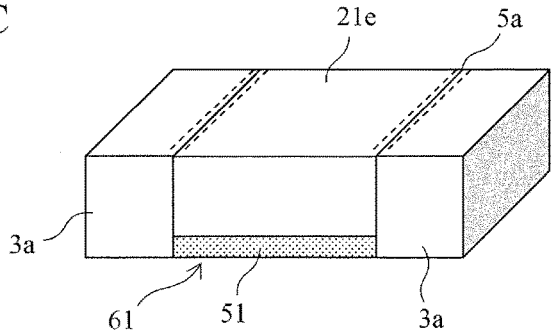

Next, the third embodiment of the present invention will be described. FIG. 6 each show a step of a method for producing a resistor in accordance with the present embodiment; specifically, FIGS. 6A and 6B show steps corresponding to FIGS. 1B and 2B, respectively. In a structure 61 shown in FIGS. 6B and 6C, after a resistive element piece 21*e*, which has been formed thinner than an electrode plate 3, is fitted into each through-hole 5 in the electrode plate 3, welding by laser or the like is performed. Then, a space corresponding to the difference in the thickness is filled with a protective film 51 of epoxy resin or the like, and the resin is then solidified. Adding such a step can obtain a structure such as the one shown in FIG. 6C and form a protective film between the electrodes through simple steps.

Fourth Embodiment

Figure 7:
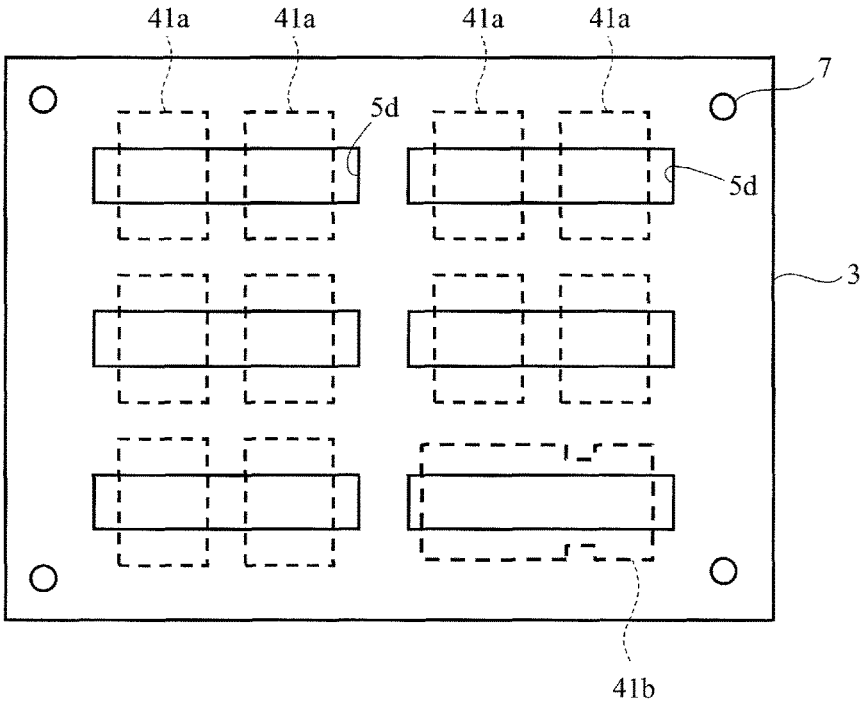
FIG. 7 is a view showing a step of a method for producing a resistor in accordance with the fourth embodiment of the present invention, and showing a state in which through-holes are formed.

Next, the fourth embodiment of the present invention will be described. FIG. 7 shows another exemplary method for producing a resistor in accordance with the present embodiment. The fourth embodiment differs from the aforementioned embodiments in that a plurality of chips (41*a*, 41*a*) are stamped per through-hole 5*d*. Accordingly, resistors can be obtained more efficiently than in the first embodiment. However, if the through-holes 5*d* are formed too long, the electrode plate 3 will warp during laser welding, which can result in a failure in fitting. Therefore, the lengths of the through-holes 5*d* should be set such that a failure in fitting will not occur. In addition, an example in which a chip indicated by reference numeral 41*b* with a different shape from those indicated by 41*a* is stamped is also shown. Stamping chips with different shapes from a single sheet material in this manner can efficiently produce resistors with different shapes.

Although an example in which chips with different shapes are stamped is shown herein, it is also possible to design resistive elements such that at least one of the shapes, lengths, widths, or thicknesses thereof differ from one another, and adjust the shapes of the through-holes 5*d* correspondingly, or use different materials for the resistive elements, for example.

According to the method for producing resistive elements in accordance with the present embodiment, there is an advantage in that the amount of waste of resistive elements produced from a sheet material can be reduced.

In the aforementioned embodiments, the configurations and the like shown in the accompanying drawings are not limited thereto, and can be changed as appropriate within the range that the advantageous effects of the present invention can be exerted. Besides, the configurations and the like can also be changed as appropriate within the spirit and scope of the present invention.

In addition, each element of the present invention can be freely selected, and an invention that includes the freely selected element is also encompassed by the present invention.

INDUSTRIAL APPLICABILITY

The present invention is applicable to a method for producing a resistor.

All publications, patents, and patent applications that are cited in this specification are all incorporated by reference into this specification.

What is claimed is:

1. A method for producing a resistor, comprising:
   - a step of forming a through-hole in a sheet-like conductive material;
   - a step of fitting a resistive element piece shaped in accordance with a shape of the through-hole into the through-hole and thus forming joint portions where end surfaces of the resistive element piece are joined to respective side surfaces of the conductive material exposed on an inside of the through-hole; and
   - a step of stamping a region from the conductive material including the joint portions, thereby forming a resistor including a resistive element formed from the resistive element piece joined to a pair of electrodes formed from the sheet-like conductive material.

2. The method for producing a resistor according to claim 1, wherein the step of fitting the resistive element piece includes a step of welding two side surfaces of the resistive element piece to the respective side surfaces of the conductive material in the through-hole at the joint portions.

3. The method for producing a resistor according to claim 2, wherein the step of fitting the resistive element piece includes a step of press-fitting the resistive element piece into the through-hole.

4. The method for producing a resistor according to claim 2, wherein in the step of stamping the region including the joint portions, a width of the region to be stamped is set narrower than a width of each of the joint portions.

5. The method for producing a resistor according to claim 2, wherein the step of forming the through-hole includes providing a protrusion at a bottom of the through-hole, the protrusion protruding from an inner surface of the sheet-like conductive material on the through-hole side toward the through-hole.

6. The method for producing a resistor according to claim 1, wherein the step of fitting the resistive element piece includes a step of press-fitting the resistive element piece into the through-hole.

7. The method for producing a resistor according to claim 6, wherein in the step of stamping the region including the joint portions, a width of the region to be stamped is set narrower than a width of each of the joint portions.

8. The method for producing a resistor according to claim 6, wherein the step of forming the through-hole includes providing a protrusion at a bottom of the through-hole, the protrusion protruding from an inner surface of the sheet-like conductive material on the through-hole side toward the through-hole.

9. The method for producing a resistor according to claim 1, wherein in the step of stamping the region including the joint portions, a width of the region to be stamped is set narrower than a width of each of the joint portions.

10. The method for producing a resistor according to claim 9, wherein the step of forming the through-hole includes providing a protrusion at a bottom of the through-hole, the protrusion protruding from an inner surface of the sheet-like conductive material on the through-hole side toward the through-hole.

11. The method for producing a resistor according to claim 1, wherein the step of forming the through-hole includes providing a protrusion at a bottom of the through-hole, the protrusion protruding from an inner surface of the sheet-like conductive material on the through-hole side toward the through-hole.

* * * * *